US005927623A

United States Patent [19]

Ferguson et al.

[11] Patent Number: 5,927,623

[45] Date of Patent: Jul. 27, 1999

[54] GYRATORY CRUSHER WITH AUTOMATIC CONTROL SYSTEM

[75] Inventors: Christopher Ferguson, Cedar Rapids; Joseph E. Musil, Ely, both of Iowa

[73] Assignee: Cedarapids, Inc., Cedar Rapids, Iowa

[21] Appl. No.: 08/953,777

[22] Filed: Oct. 17, 1997

Related U.S. Application Data

[63] Continuation of application No. 08/617,624, Mar. 18, 1996, abandoned.

[51] Int. Cl.[6] ..... B02C 25/00

[52] U.S. Cl. ..... 241/36; 241/37; 241/207

[58] Field of Search ..... 241/207–216, 241/36, 37, 286, 290

[56] References Cited

U.S. PATENT DOCUMENTS

| | | | |
|---|---|---|---|
| 3,305,181 | 2/1967 | Barrot et al. | 241/37 |
| 4,712,743 | 12/1987 | Nordin | 241/37 X |
| 4,793,560 | 12/1988 | Schrodl | 241/37 X |
| 4,856,716 | 8/1989 | Burstedt | 241/37 X |

FOREIGN PATENT DOCUMENTS

| | | | |
|---|---|---|---|
| 2676660 | 11/1992 | France | 241/37 |
| 6-154630 | 6/1994 | Japan | 241/37 |
| 1416181 | 8/1988 | U.S.S.R. | 241/37 |
| 2357432 | 5/1975 | United Kingdom | 241/37 |

*Primary Examiner*—Mark Rosenbaum

*Attorney, Agent, or Firm*—Marshall, O'Toole, Gerstein, Murray & Borun

[57] ABSTRACT

A gyratory crusher includes a control system, an upper frame portion having a bowl liner, and a crushing head having a mantel such that a crushing chamber having a gap is formed between the bowl liner and the mantel. The control system includes detecting means for detecting a pre-defined bowl float condition of the crusher, adjusting means for automatically adjusting a width of the gap to thereby eliminate the bowl float condition, and monitoring means for determining magnitude and direction of changes in the width of the gap by monitoring rotation of the bowl liner relative to the upper frame portion. The control means is adapted to automatically adjust the width of the gap to operatively compensate for a wearing rate of the bowl liner and the mantel and to terminate operation of the crusher should rate of bowl float conditions exceed a pre-determined quantity.

27 Claims, 11 Drawing Sheets

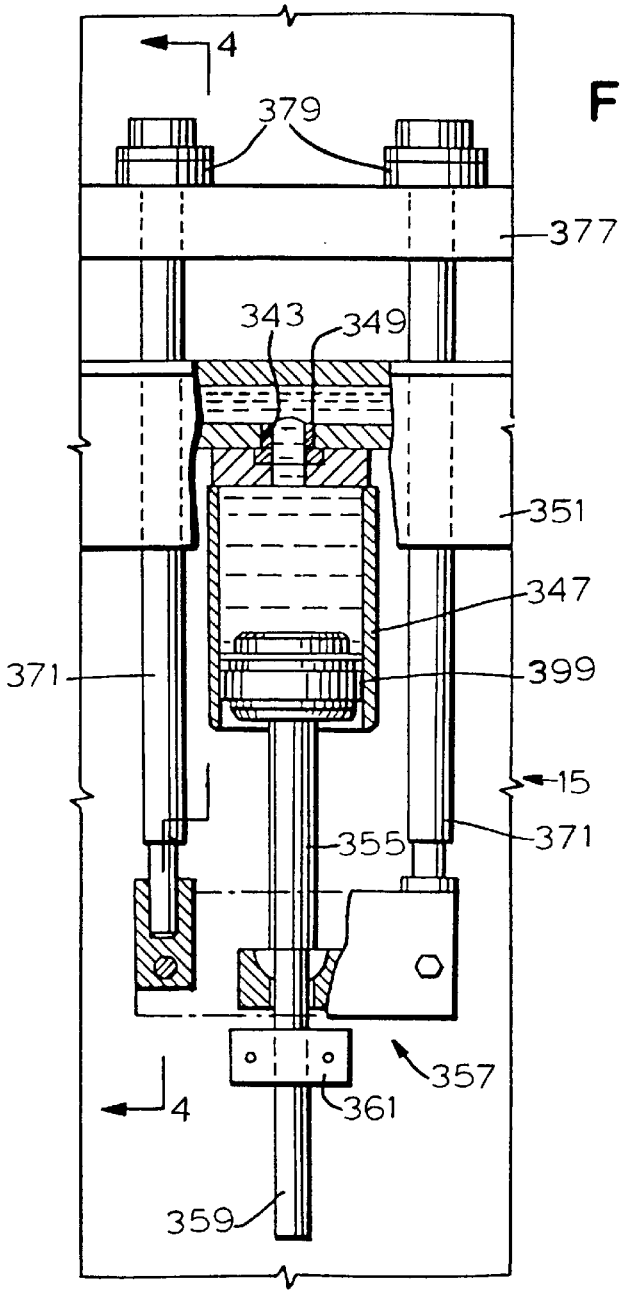
FIG. 3
FIG. 4
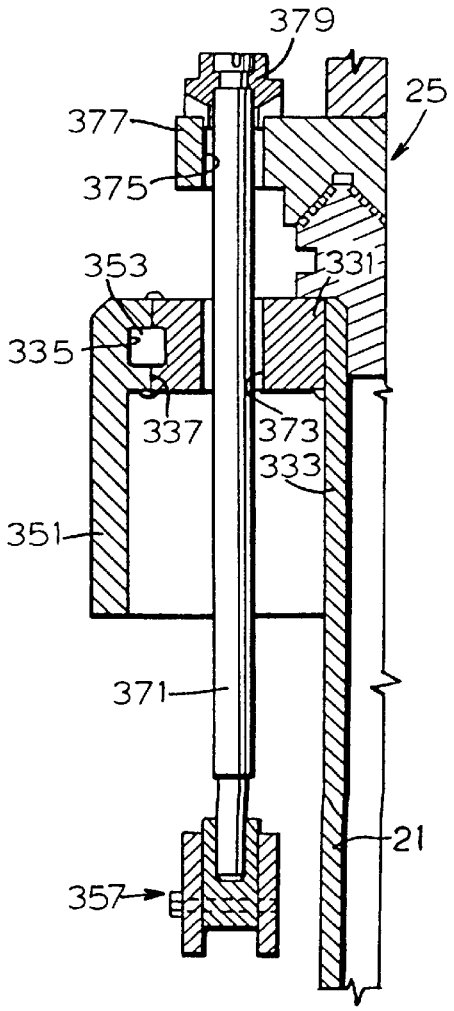

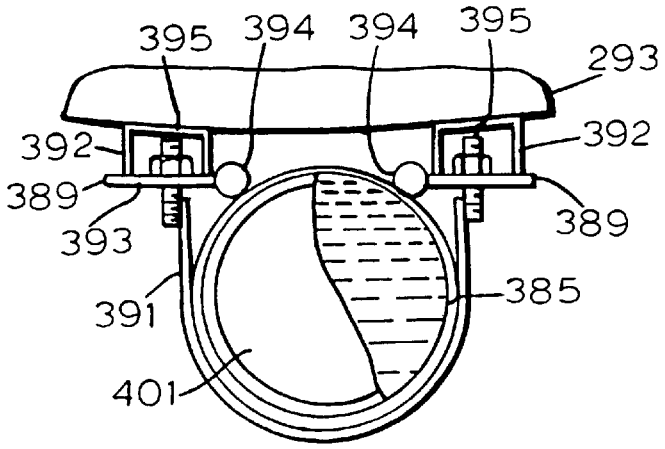
FIG. 5
FIG. 6
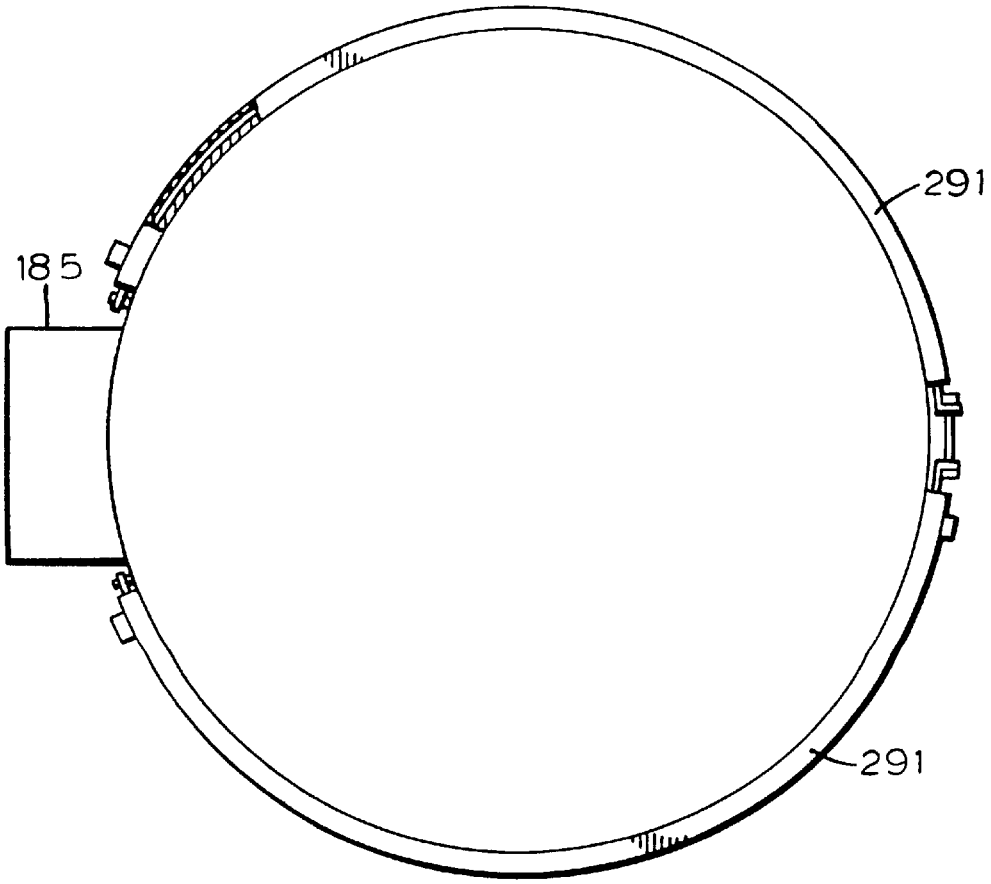

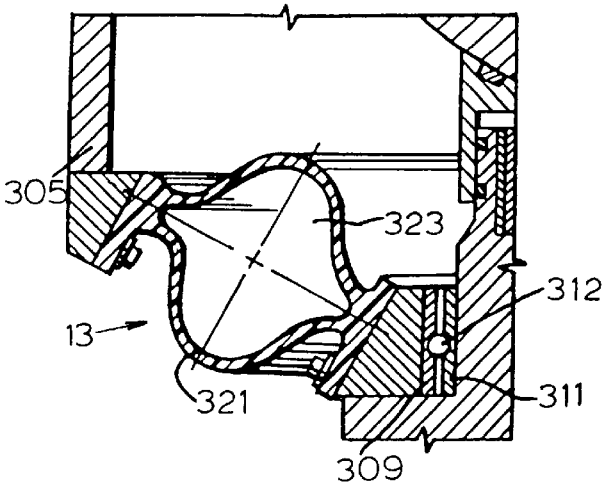
FIG. 12
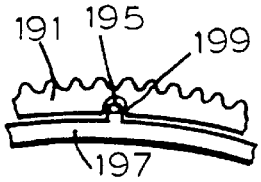
FIB. 14
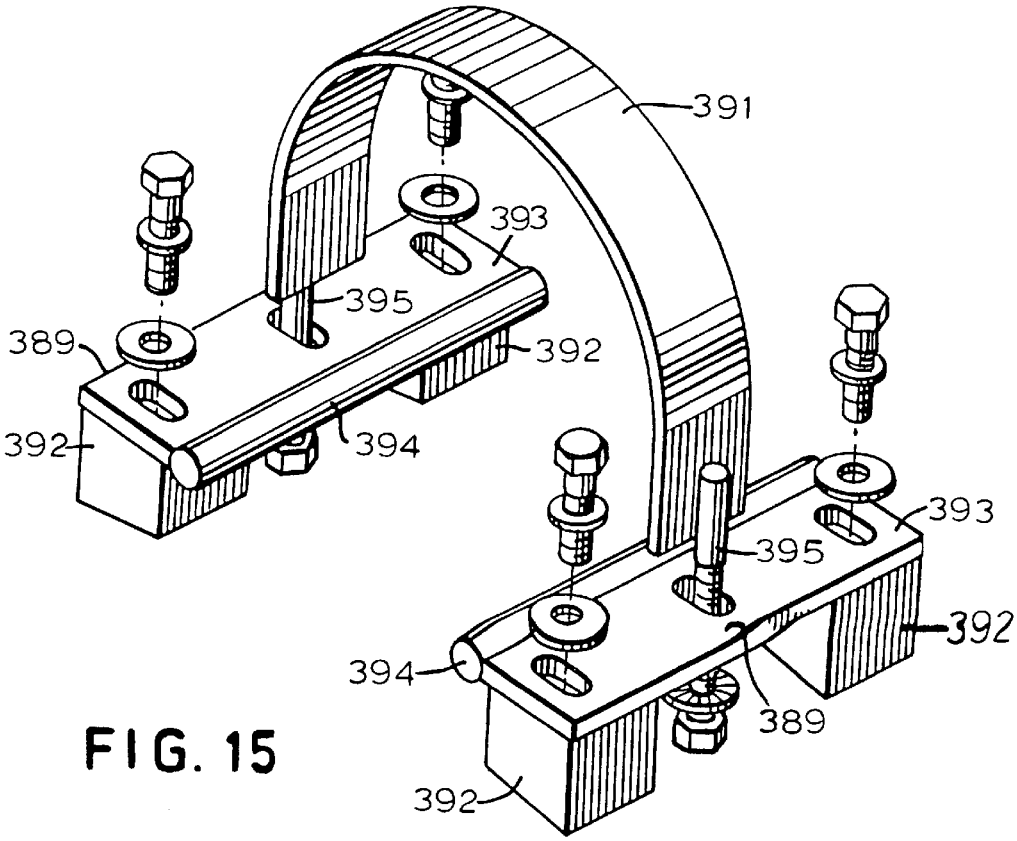
FIG. 15

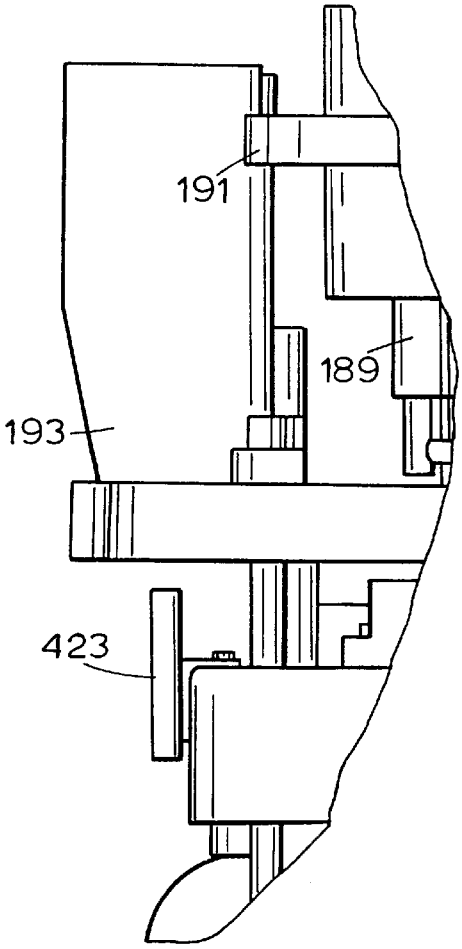
FIG. 16
FIG. 18
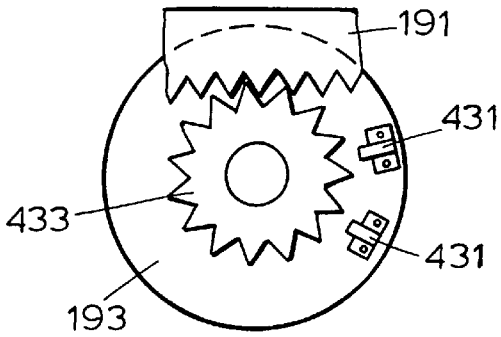
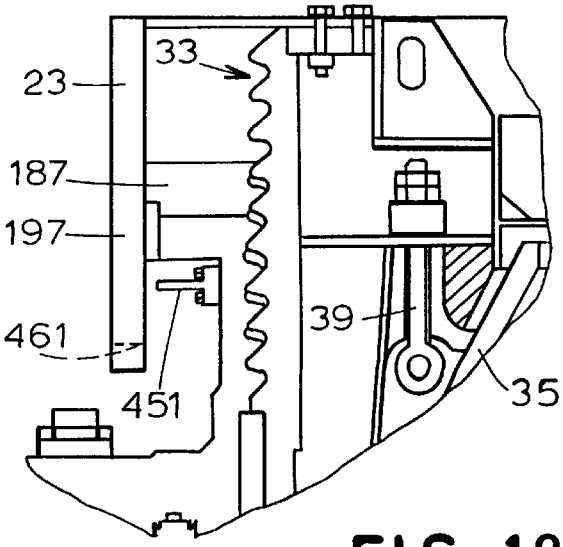
FIG. 19

GYRATORY CRUSHER WITH AUTOMATIC CONTROL SYSTEM

This is a Continuation of U.S. application Ser. No. 08/617,624, filed Mar. 18, 1996, now abandoned.

BACKGROUND OF THE INVENTION

The invention relates generally to controls for a gyratory or cone crusher.

Gyratory crushers or cone crushers are characterized by crushing heads having a generally cone-shaped outer surface, which are mounted to undergo gyratory motion. The cone-shaped crushing head of a gyratory crusher is generally centered about a cone axis that is angularly offset from a vertical crusher axis generally centered through the crusher. The outer surface of the head is protected by a replaceable mantel.

The crushers are further characterized by a bowl-shaped member, sometimes referred to as a concave or bonnet, disposed in an inverted position generally over the cone-shaped crushing head and centered on the vertical crusher axis. The inner surface of the bowl-shaped member is protected by a replaceable bowl liner. The outer dimensions of the head and mantel are smaller than the corresponding inner dimensions of the bowl liner. The head is mounted such that there is a space between the mantel and the bowl liner, sometimes referred to as the "crushing chamber" or "crushing cavity". The volume of the crushing cavity can be increased by altering the shape of the exposed surface of the bowl liner and/or the shape of the exposed surface of the mantel. It can also be increased or decreased by vertically adjusting the separation between the mantel and the bowl liner. The bowl-shaped member has an upper opening through which material to be crushed can be fed into the crushing cavity.

The smallest distance between the mantel and the bowl liner at the bottom of the crushing cavity is called the "closed side setting" or "setting" of the crusher. The width of the setting determines the size of crushed materials operably produced by the crusher. The setting can be enlarged to increase the size of the crushed material produced by the crusher, and can be decreased to reduce the size of the crushed material produced by the crusher. The setting can be adjusted by simply raising or lowering the elevation of the bowl liner relative to the elevation of the cone head. The setting of some cone crushers is adjusted by raising or lowering the head. The difference between the width of the closed side setting and the spacing between the mantel and the bowl liner at the bottom of the crushing cavity directly opposite from the closed side setting, sometimes called the "open" side or "open side setting", is called the "throw" or "stroke" of the crusher.

The small angular offset of the cone axis relative to the vertical crusher axis is provided by mounting the head on an eccentric element, or other suitable mounting. The head is caused to gyrate relative to the bowl-shaped member by rotating that mounting or eccentric element. As the eccentric element rotates, one side of the head is caused to approach the bowl liner until it attains the closed side setting while the opposite side of the head recedes from the bowl liner until it simultaneously attains the open side setting. The closed side setting and open side setting operably travel around the periphery of the lower end of the crushing cavity as the eccentric element is rotated, each making a complete revolution around the cone head for each revolution of the eccentric element. The magnitude of the gyration is determined by the angle that the cone axis is offset from the crusher axis and by the location of the point at which those two axes most closely approach or intersect.

State-of-the-art gyratory or cone crushers are generally driven by a horizontally disposed countershaft which radially extends into a lower part of a generally cylindrical crusher housing. An inner end of the countershaft is coupled through a pinion and ring gear to the eccentric element to rotatably drive the eccentric element.

A motor (either electric or combustion) is used to drive the crusher. The speed of the motor, the size ratio of the pulleys on the motor and the crusher, and the gearing of the eccentric element determine the speed at which the head gyrates, sometimes referred to as the "gyrational speed". The gyrational speed selected for each crusher depends on the particular application for which the crusher is to be used. Increasing or decreasing the gyrational speed is usually a matter of changing the speed of the motor, changing the relative sizes of the pulleys on the motor and the crusher, and/or changing the gear ratios for the eccentric.

The gyratory or gyrating motion of the cone-shaped crushing head performs a material comminution action on material, such as rock, ore, coal and other hard substances, as the material is fed through the bowl opening into the crushing cavity. The material typically moves by gravity through the annular space between the exposed surface of the stationary bowl liner and the exposed surface of the cone-shaped mantel. As the gyrating head approaches the liner, it crushes the material; as it recedes from the liner, the material falls farther down the crushing cavity to undergo further crushings during subsequent revolutions of the eccentric member and as the separation between the bowl liner and the head gradually decreases from top to bottom. This progressive crushing action repeatedly occurs until the crushed material is discharged from the bottom of the crushing cavity.

A problem with prior art crushers is the inability to automatically detect and eliminate a bowl float condition. Of course, some of such bowl float conditions are quickly alleviated by tramp iron relief systems. If prolonged, however, a bowl float condition can quickly cause substantial damage to a crusher.

Another problem with prior art crushers is the inability to operatively and automatically compensate for wearing away of the crushing surfaces of a bowl liner and a mantel forming a crushing cavity within the crushers.

A further problem with prior art crushers is the inability to expeditiously arrange for bowl liners thereof to be vertically hoistable for maintenance or replacement.

What is needed is a crusher having an automatic control system or an automatic control system for a crusher wherein a bowl float condition is automatically detected and eliminated, for automatically compensating for wearing away of the crushing surfaces of the crusher as the crusher is being operated, and for automatically adjusting a bowl liner such that the bowl liner is vertically hoistable from the crusher.

SUMMARY OF THE INVENTION

An improved gyratory crusher is provided for crushing rock, ore, coal and other hard substances. The gyratory crusher includes a lower frame portion, an upper frame portion supported by the lower frame portion, and a bonnet supported by the upper frame portion. The bonnet has an upper opening for receiving the material to be crushed.

The gyratory crusher also includes an eccentric member and a conically shaped crusher head. The eccentric member is pivotally mounted on the lower frame portion about a crusher axis spaced centrally and vertically relative to the lower frame member. The crusher head is pivotally mounted on the eccentric member about a cone head axis spaced generally centrally and vertically relative to the lower frame portion wherein the cone head axis is angularly offset from the crusher axis and intersects the crusher axis above the crusher head. A crushing chamber is formed between the crusher head and the bonnet.

The mounting arrangement of the gyratory crusher also includes a plurality of hydrostatic bearings for operably supporting the crusher head, a pair of taper bearings configured to operatively provide rotational displacement of the eccentric member about the crusher axis, and a spherical bearing configured to operatively provide rotational displacement of the crusher head about the cone head axis. The crusher head is mounted on a main shaft having a tapped partial bore adapted to threadably receive a mantel stud. One or more partial bores spaced across the threads of the tapped partial bore and the threads of the mantel stud are each adapted to receive a dowel pin as the mantel stud is in threaded engagement with the tapped partial bore. The dowel pin or pins prevent overtightening of the self-tightening mantel stud during crushing operations of the gyratory crusher.

The gyratory crusher also includes a flexible seal that is configured to operatively protect moving components thereof from dust and grit generated during crushing operations. An outer edge of the flexible seal is secured to the crusher head and an inner edge of the flexible seal is secured to an outer race of a ball bearing seal, the inner race of which is secured to non-rotating members of the mounting arrangement.

The gyratory crusher also includes a hydraulic tramp iron relief system that is configured to automatically allow uncrushable material to pass through the crushing chamber. The tramp iron relief system includes channels formed internally within the structure of the lower frame portion to connect cylinders and accumulators of the tramp iron relief system in high-pressure hydraulic fluid flow communication.

The gyratory crusher also includes a self-contained lubricating system configured to operatively lubricate the moving components and sliding interfaces thereof, and to operably transfer thermal energy from the moving parts of the mounting arrangement to the lower frame portion to thereby reduce thermal stress within the crusher.

A driving arrangement, including a bevel gear centered about the crusher axis and secured directly to the eccentric member, provides power for operating the crusher.

The crusher also comprises a control system for automatically controlling the width of the gap during operation of the crusher. The control system includes one or more separation sensors configured to operatively detect separation of the upper frame portion from the lower frame portion. The separation sensors generate signals that are proportional to the magnitude of corresponding separations of the upper frame portion from the lower frame portion adjacent to the respective separation sensor.

The control system is configured to operatively detect a pre-defined bowl float condition of the crusher and to responsively increase the width of the gap upon detection of such a bowl float condition. The control system is configured to operatively control magnitude and direction of changes in width of the gap by monitoring rotation of the bonnet relative to the upper frame portion and to determine the relative displacement of the bonnet relative to the upper frame portion as the gap has a minimal width.

The control system is also configured to operatively compensate for a wearing rate of the bowl liner and the mantel by responsively displacing the bowl liner relative to said mantel. The control system provides for periodically recalibrating the relative displacement of the bonnet relative to the upper frame portion as the gap has a minimal width to thereby determine an updated or "learned" wearing rate of the bowl liner and the mantel.

Further, the control means is configured to operatively adjust the width of the gap in response to changes in amperage drawn as the crusher is driven by electrically powered drive means and/or in response to changes in temperature of fluid being circulated through the crusher. In addition, the control means is configured to operatively adjust said bonnet such that said bonnet is vertically hoistable from the upper frame portion to expeditiously facilitate removal and replacement of inner components of the crusher, and to track quantity of bowl float conditions occurring within a selected time interval including shutting down the crusher in the event that the quantity of bowl float conditions occurring within a selected time interval exceeds a pre-determined quantity.

PRINCIPAL OBJECTS AND ADVANTAGES OF THE INVENTION

The principal objects and advantages of the present invention include: providing a gyratory crusher that has an automatic control system and providing a control system for automatically controlling a gyratory crusher; providing such a crusher and control system that automatically controls a width of a close side setting of the crusher during operation thereof; providing such a crusher and control system that automatically detects separation of an upper frame portion from a lower frame portion of the crusher; providing such a crusher and control system that automatically generates signals that are proportional to the magnitude of separation of an upper frame portion from a lower frame portion of the crusher; providing such a crusher and control system that automatically detects a pre-defined bowl float condition of the crusher; providing such a crusher and control system that automatically increases a closed side setting of the crusher upon detection of a bowl float condition of the crusher; providing such a crusher and control system that automatically controls magnitude and direction in changes of a closed side setting of the crusher by monitoring rotation of a bonnet relative to an upper frame portion of the crusher; providing such a crusher and control system that automatically determines displacement of a bonnet relative to an upper frame portion of the crusher whereat a closed side setting of the crusher is determined by onset of a bowl float condition of the crusher; providing such a crusher and control system wherein a bowl liner is automatically displaced relative to a mantel of a crusher to compensate for a wearing rate of the crushing surfaces of the bowl liner and the mantel; providing such a crusher and control system wherein a closed side setting of the crusher is automatically adjusted in response to changes in amperage as the crusher is driven by an electrically powered prime mover; providing such a crusher and control system wherein a closed side setting of the crusher is automatically adjusted in response to changes in temperature of a fluid being circulated through the crusher; providing such a crusher and control system wherein a bonnet of the crusher is automatically adjusted whereby access to inner components of the crusher are expeditiously provided; providing such a crusher and control system wherein a quantity of bowl float conditions occurring within a selected time interval are tracked; providing such a crusher and control system wherein operation of the crusher is automatically terminated in the event that the quantity of bowl float conditions occurring within a selected time interval exceeds a pre-determined quantity; and generally providing such a crusher and control system that are efficient in operation, capable of long operating life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 3 is an enlarged and fragmentary, side elevational view of the gyratory crusher having an automatic control system, showing one of the plurality of cylinders of the tramp iron relief system with portions broken away to reveal details thereof.

FIG. 4 is a further enlarged and fragmentary, side elevational and cross-sectional view of one of the plurality of cylinders of the tramp iron relief system of the gyratory crusher having an automatic control system, taken along line 4—4 of FIG. 3.

FIG. 5 is an enlarged and fragmentary, top plan view of one of the plurality of accumulators of the tramp iron relief system of the gyratory crusher having an automatic control system taken along line 5—5 of FIG. 2, with portions broken away to reveal details thereof.

FIG. 6 is a fragmentary top plan view of the gyratory crusher having an automatic control system taken along line 6—6 of FIG. 2 with a portion cut away to reveal details thereof, showing a thermal stress relief arrangement thereof.

FIG. 12 is a yet further enlarged and fragmentary view of the gyratory crusher having an automatic control system, similar to that of FIG. 10 but showing an alternate dust seal arrangement.

FIG. 14 is a fragmentary and further enlarged plan view of the elevating arrangements of the gyratory crusher having an automatic control system.

FIG. 15 is a further enlarged, partial exploded and perspective view of accumulator attaching means of the gyratory crusher having an automatic control system.

FIG. 16 is an enlarged and fragmentary, side elevational view of the gyratory crusher having an automatic control system, showing a separation sensor thereof.

FIG. 18 is an enlarged and fragmentary, plan view of the gyratory crusher having an automatic control system, showing monitoring means thereof.

FIG. 19 is an enlarged and fragmentary, partially cross-sectional side elevation view of the gyratory crusher having an automatic control system, showing indicator means thereof, according to the present invention.

DETAILED DESCRIPTION OF THE INVENTION

Figure 1:
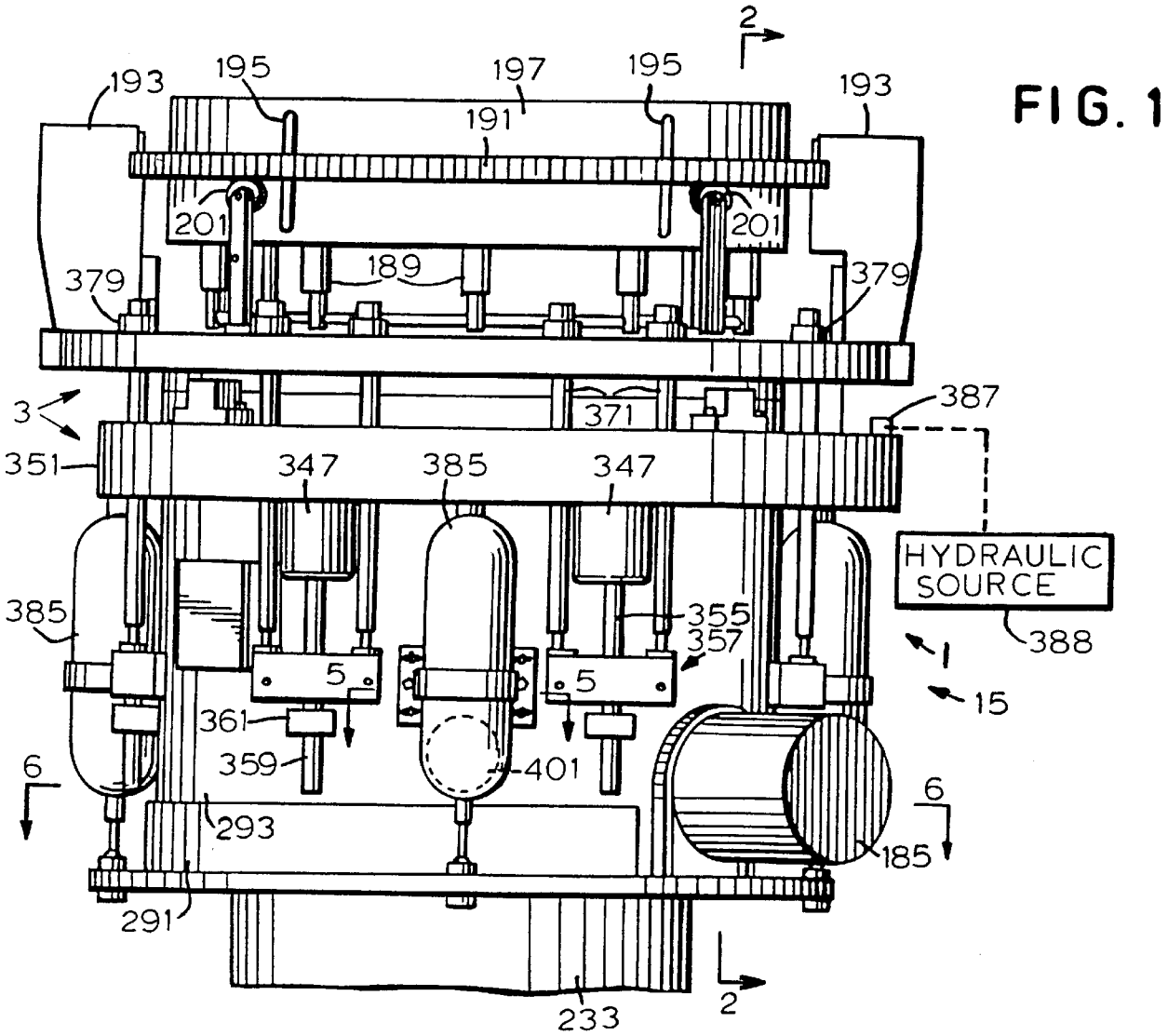
FIG. 1 is a fragmentary, side elevational view of a gyratory crusher having an automatic control system including an elevating arrangement and cylinders and accumulators of a tramp iron relief system thereof, in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a gyratory crusher in accordance with the present invention, as shown somewhat simplified to highlight particular features of the present invention in FIGS. 1 through 15. The crusher 1 includes frame means 3, head mounting means 5, adjusting means 7, lubricating means 9, thermal stress relief means 11, dust seal means 13, and a tramp iron relief system 15.

Figure 7:
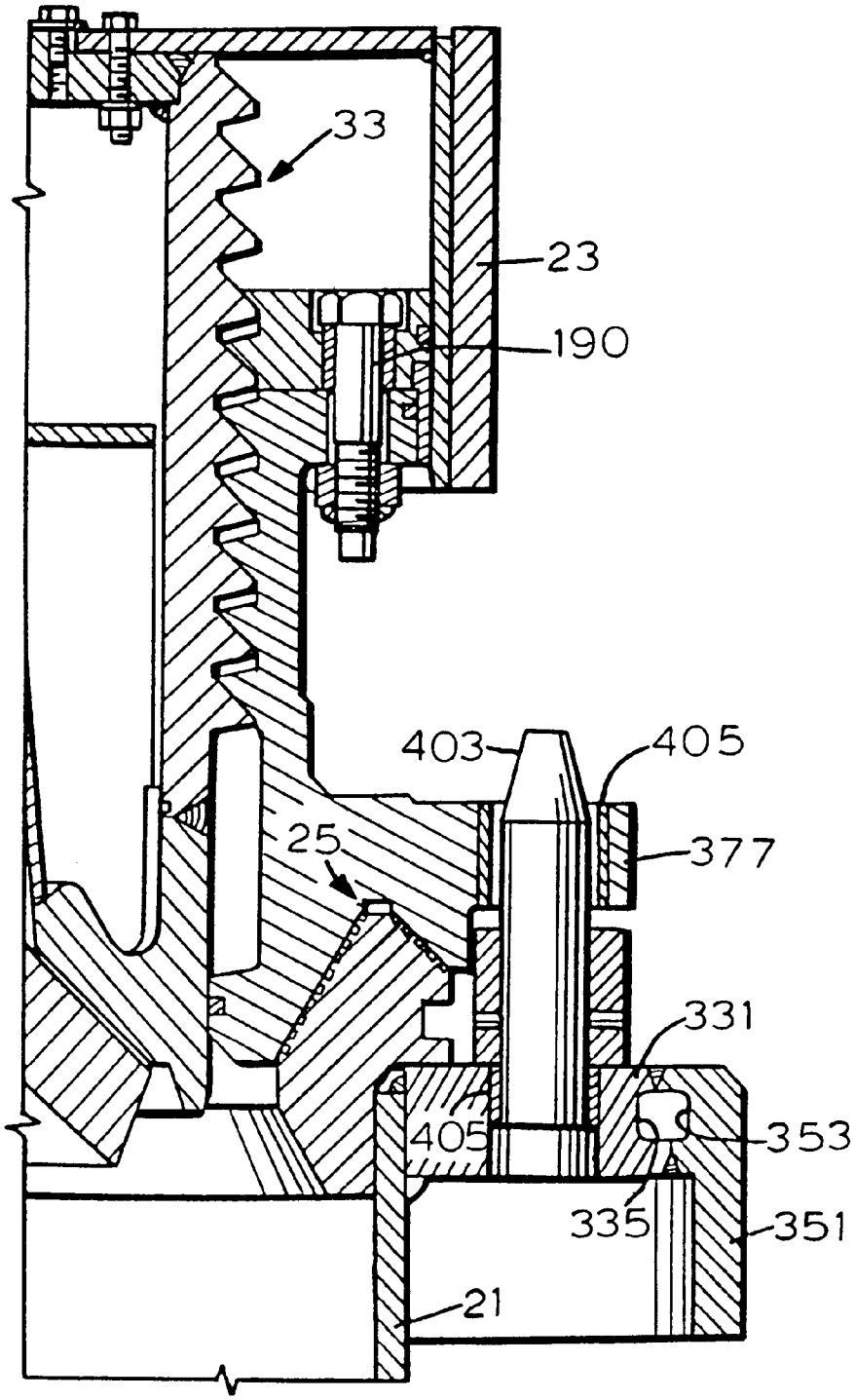
FIG. 7 is a further enlarged and fragmentary, partially cross-sectional and side elevational view of a stop pin arrangement of the gyratory crusher having an automatic control system.

The frame means 3 includes a lower frame portion 21 and an upper frame portion 23. A "V-seat" arrangement 25, as shown in FIG. 7, is peripherally situated between the lower frame portion 21 and the upper frame portion 23, similar to that disclosed in U.S. Pat. No. 4,773,604 entitled "Seat Member for Gyratory Rock Crusher Bowls" and issued Sep. 27, 1988. A bowl, concave or bonnet 31 is mounted on the upper frame portion 23 by threads 33. A bowl liner 35 having an exposed surface 37 is replaceably mounted on the bonnet 31 by liner connectors 39. The bowl liner 35 is a wear item that is replaceable while the crusher 1 is shut down during maintenance periods. The upper frame portion 23, the bonnet 31 and the bowl liner 35, which may be collectively referred to herein as an upper assembly 41, are all centered about a vertically oriented crusher axis 51, located centrally through the crusher 1. The bowl liner 35 has the general shape of a hollow truncated pyramid with a generally circularly shaped upper opening 53 and a wider, generally circularly shaped lower opening 55. The upper opening 53 provides a material feed or intake opening for the crusher 1.

Partially located within the bowl liner 35, and extending through the lower opening 55 into the space encompassed by the bowl liner 35, is a crusher head or cone head 61 of the crusher 1. The cone head 61 is generally conically shaped.

A mantel 63, replaceably mounted on the cone head 61, provides a conical upwardly facing crushing surface 65 for the cone head 61. The cone head 61 is centered about a generally vertically oriented cone head axis 67, which is disposed and supported at an angle of deviation, as indicated by the numeral 69 in FIG. 2, with respect to the crusher axis 51. The cone head axis 67 and the crusher axis 51 intersect at an apex of gyration or apex 71 that lies centrally above the crusher 1. During the operation of the crusher 1, the cone head 61 gyrates about the apex 71 with respect to the bonnet 31.

Figure 2:
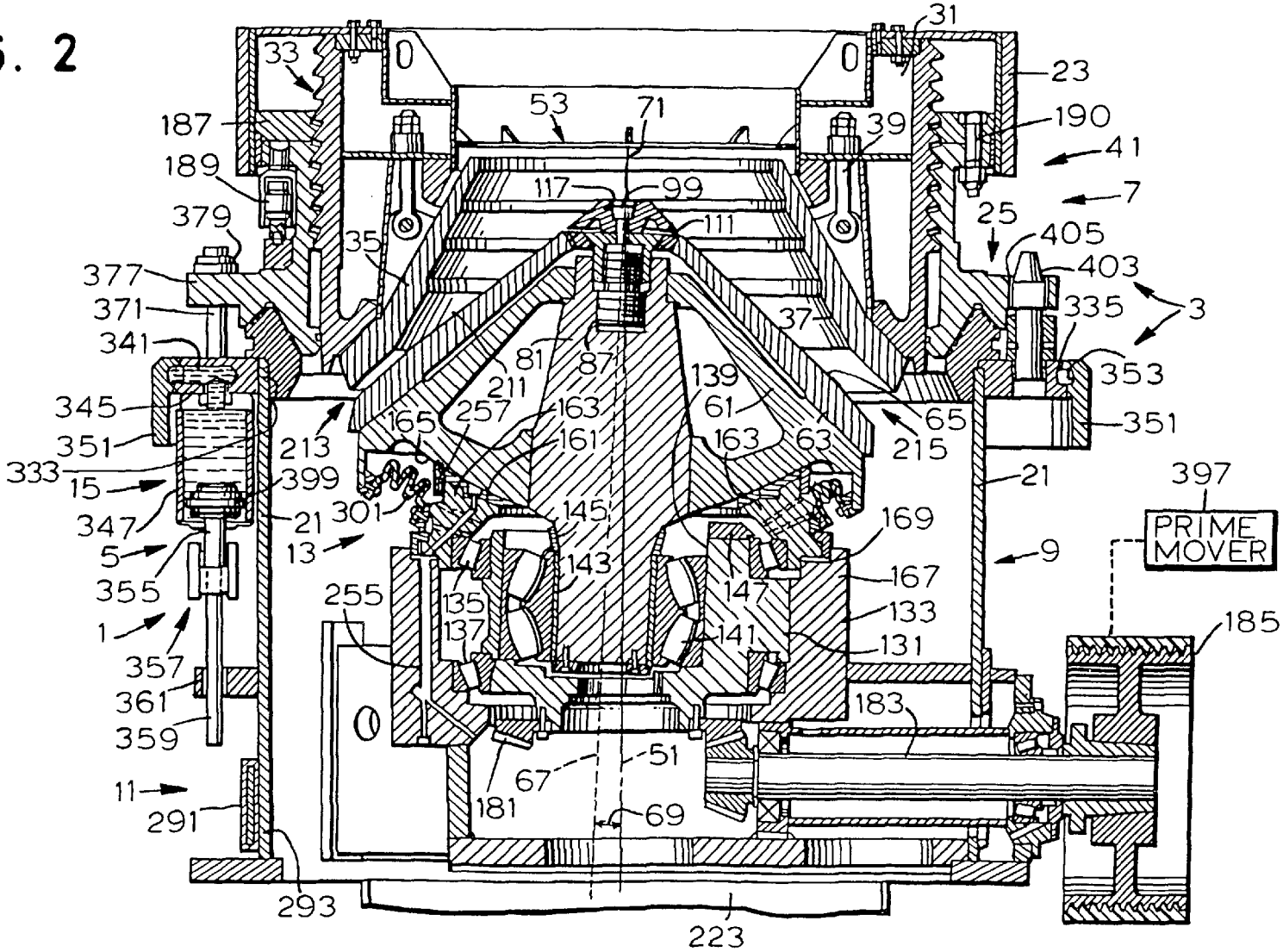
FIG. 2 is a fragmentary, partially cross-sectional view of the gyratory crusher having an automatic control system, taken along line 2—2 of FIG. 1.
Figure 9:
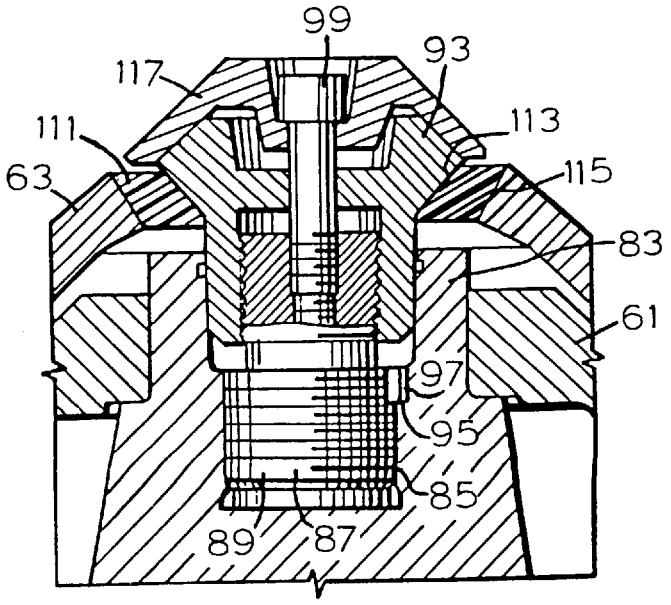
FIG. 9 is a further enlarged and fragmentary, partially cross-sectional view of the gyratory crusher having an automatic control system, showing a mantel stud thereof.

The head mounting means 5 includes a main shaft 81, centered about the cone head axis 67, for receiving the cone head 61, as shown in FIG. 2. An upper end 83 of the main shaft 81 has a tapped partial bore 85 for threadably receiving a mantel stud 87, as shown in FIG. 9.

The mantel stud 87 has an inner threaded portion 89 for mating with the partial bore 85 and an outer threaded portion 91 for mating with a mantel nut 93 as hereinafter described. The handedness of the inner threaded portion 89 and the outer threaded portion 91 is such that the mantel stud 87 and the mantel nut 93 are self-tightening. The threads of the inner threaded portion 89 and the outer threaded portion 91 have an appropriate pitch, such as four threads per inch for the outer threaded portion 91 and six threads per inch for the inner threaded portion 89.

At least one, preferably two or more, partial bores 95, axially aligned with the cone head axis 67, are located across the mated threads of the partial bore 85 and the inner threaded portion 89 for receiving a respective dowel pin 97 therein. The dowel pins 97 are adapted to prevent over-tightening of the mantel stud 87 during the crushing operation and to thereby facilitate subsequent removal or replacement of the mantel stud 87, thereby allowing low-cost replacement of a corresponding thread system that holds a mantel bolt 99 without having to remove or replace the main shaft 81.

The mantel 63 is attached to the cone head 61 by placing the mantel 63 on the cone head 61 and placing a mantel washer or "torch ring" 111 over the outer threaded portion 91. The mantel nut 93 is threadably advanced along the outer threaded portion 91. The mantel nut 93 has outwardly tapered shoulders 113 which, in conjunction with the torch ring 111 and an appropriately sized and shaped orifice 115 through the mantel 63, centers and secures the mantel 63 to the cone head 61. A mantel cap 117 is secured to the mantel nut 93 by the bolt 99 to protect the mantel nut 93 and the torch ring 111 from material falling through the upper opening 53.

Figure 11:
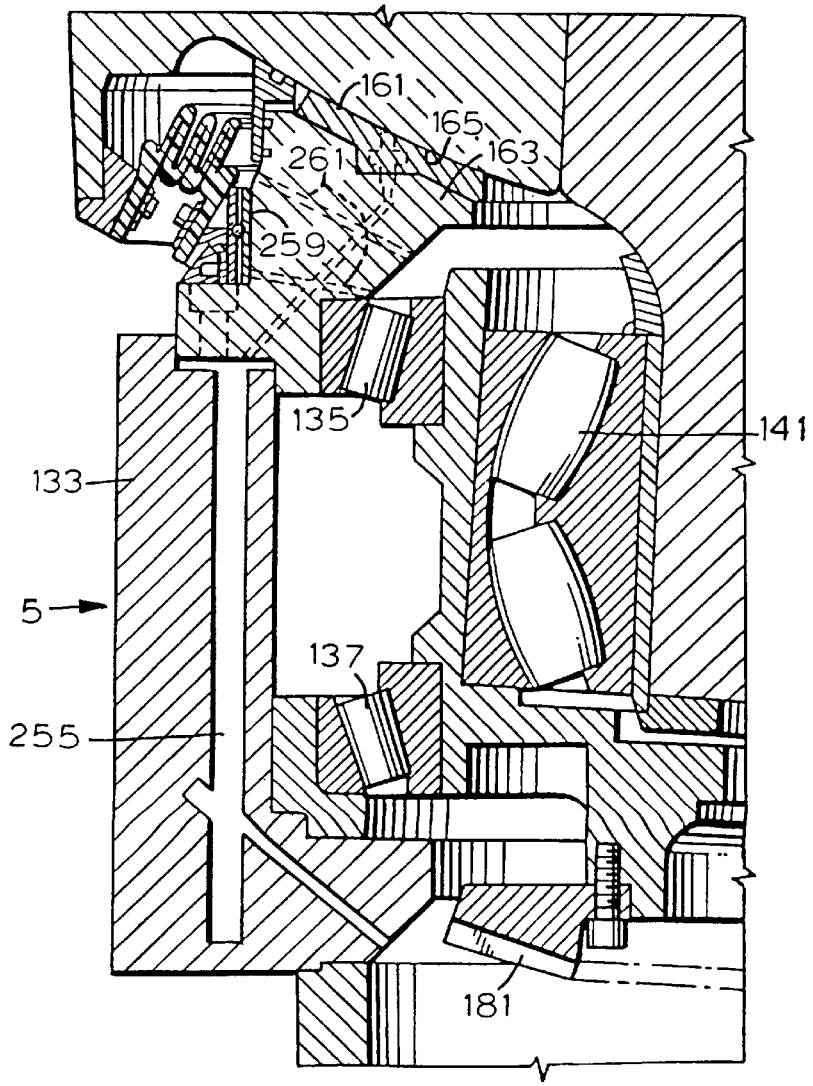
FIG. 11 is a fragmentary view of the gyratory crusher having an automatic control system, similar to that of FIG. 10 but showing the dust seal arrangement in the vicinity of an open side setting of the gyratory crusher.

The head mounting means 5 also includes an eccentric member 131 mounted within an encasement portion 133 of the lower frame portion 21. Rotational movement of the eccentric member 131 relative to the encasement portion 133 is provided by a pair of taper bearings 135, 137 centered about the crusher axis 51, as shown in FIG. 11.

A cavity 139, formed within the eccentric member 131, is configured to provide the angular offset 69. Rotational movement of the cone head 61 relative to the eccentric member 131 is provided by a spherical bearing 141 centered about the cone head axis 67. A bushing 143 and a spacer 145 about the main shaft 81 appropriately locate the spacing of the spherical bearing 141 relative to the main shaft 81. Counterweight 147 can be attached to the eccentric member 131 to balance the gyratory forces, as needed.

To provide adequate mounting for the taper bearings 135, 137 while also providing added support for the substantial stress forces generated during the crushing operating, the cone head 61 is mounted in abutting engagement with a plurality of hydrostatic bearings 161, mounted on thrust seats 163 equidistantly spaced around the crusher axis 51. A bottom surface 165 of the cone head 61 is spherically shaped with the center of curvature thereof located at the apex 71 whereby the abutting engagement between the hydrostatic bearings 161 and the surface 165 form a sliding interface as the cone head 61 gyrates during the crushing operation.

The thrust seats 163 are mounted on and jointly supported by an upper side 167 of the encasement portion 133 and the taper bearings 135, 137. The primary purpose for partially supporting the cone head 61 by the taper bearings 135, 137 is to "load" the taper bearings 135, 137. In so doing, the eccentric member 131 is precisely located, both axially and radially, relative to the encasement portion 133. Selected ones of a plurality of shims 169 having different thicknesses provide the desired loading of the taper bearings 135, 137.

By precisely mounting and locating the eccentric member 131 relative to the encasement portion 133 with the taper bearings 135, 137, a gear 181, such as a spiral bevel gear, can be centered about the crusher axis 51 and attached directly to the eccentric member 131, thereby eliminating the more complicated, more expensive and higher maintenance gear arrangements of the prior art arrangements. A drive train or drive pinion arrangement 183, meshed with the gear 181 and connected to a sheave 185 or other suitable means, provides means for powering the crusher 1.

The crushing operation is effected by the spacing between the cone head 61 and the bonnet 31 or, more particularly, the spacing between the mantel 63 and the bowl liner 35. A releasable clamping arrangement 187 jams the opposing threads 33 against each other to prevent relative rotation of the threads 33 except when desired. Preferably, the clamping arrangement 187 is activated by appropriately spaced hydraulic cylinders 189. For emergency or transporting purposes, the clamping arrangement may be activated by utilizing bolts and nuts 190. It should be understood that the bolts and nuts 190 are not used when using control system 421 as hereinafter described.

Wear occurring on the respectively exposed mantel surface 65 and the bowl liner surface 37 tends to increase the spacing therebetween. Consequently, the adjusting means 7, which provides periodic corrective adjustments of the spacing between the mantel 63 and the bowl liner 35, includes the threads 33 which permit continuous adjustment of the axial position of the bonnet 31 in a step-less up or down displacement by rotating the bonnet 31 about the crusher axis 51 with respect to the upper frame portion 23, using the the ring gear 191, and a pair of drive motors 193, as shown in FIG. 1.

The adjusting means 7 also includes a plurality, four for example, of vertically oriented cleats 195 secured to a wall 197 of the bonnet 31. The ring gear 191 has a corresponding plurality of vertically oriented grooves 199. The ring gear 191, cleats 195 and grooves 199 are configured whereby the ring gear 191 can be displaced vertically alongside the wall 197 but cannot be horizontally rotated relative to the wall 197 due to interaction between the cleats 195 and the grooves 199, as shown in FIG. 14.

The drive motors 193 are mounted on the lower frame portion 21. A plurality of rollers 201, supporting the ring gear 191, are also mounted on the lower frame portion 21 whereby the ring gear 191 is maintained in gearing engagement with the drive motors 193.

To adjust the separation between the mantel 63 and the bowl liner 35, the hydraulic cylinders 189 are bled whereby the jamming pressure between the opposing threads 33 is reduced allowing the drive motors 193 to displace the mating surfaces of the threads 33 relative to each other. Then, the drive motors 193 are activated whereby the ring gear 191 is horizontally rotated. If it is desired to increase the separation between the bowl liner 35 and the mantel 63, the drive motors 193 are operated in unison to cause the upper bonnet 31 to be threadably advanced upwardly. Conversely, if it is desired to decrease the separation between the bowl liner 35 and the mantel 63, the drive motors 193 are operated in unison in the opposite direction to cause the upper frame portion 23 to be threadably advanced downwardly. After attaining the desired separation between the bowl liner 35 and the mantel 63, forces exerted by the clamping arrangement 187 are increased to maintain the newly established separation.

Included conical angles of the bowl liner 35 and the mantel 63 are configured to provide an annular space or crushing chamber 211 between the bowl liner surface 37 and the mantel surface 65, the width thereof generally decreasing downwardly. An annular gap 213 at the lower opening 55 between the bowl liner 35 and the mantel 63 constitutes an annular material discharge opening 215 from the crushing chamber 211. During operation of the crusher 1, material is fed into the crushing chamber 211 through the upper opening 53, which material is gravitationally urged downwardly through the annular crushing chamber 211 and is reduced in size through repeated crushing contacts between the adjacent surfaces 37 and 65 of the bowl liner 35 and the mantel 63.

Figure 8:
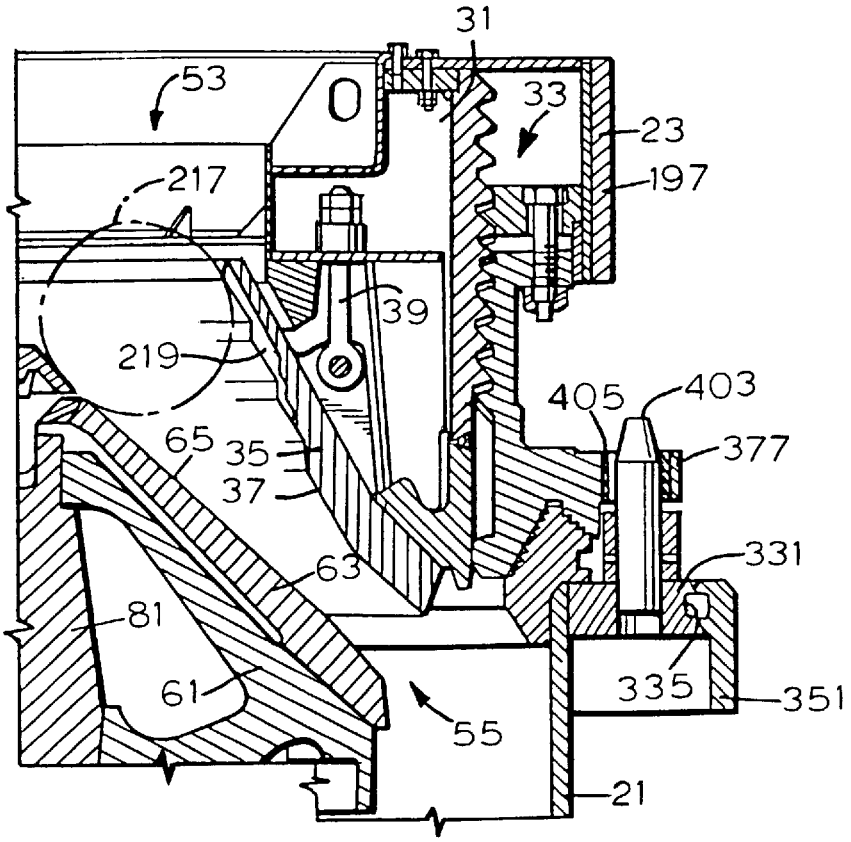
FIG. 8 is an enlarged and fragmentary, partially cross-sectional and side elevational view of a fluted bowl liner of the gyratory crusher having an automatic control system.

The maximum size of material that can be crushed by the crusher 1 is determined by the spacing between the uppermost ends of the bowl liner surface 37 and the mantel surface 65, as indicated by the phantom circle designated by the numeral 217 in FIG. 8. If desired, a plurality of flutes 219 may be formed in the bowl liner surface 37, as shown in FIG. 8, whereby occasional oversized material may be received by the crushing chamber 211 to thereby increase the maximum opening of the crushing chamber 211 without increasing the size of the crusher 1.

The lubricating means 9 of the crusher 1 is self-contained and includes a first pumping arrangement 231 for circulating oil through the crusher 1 for lubricating the various moving parts thereof.

Figure 13:
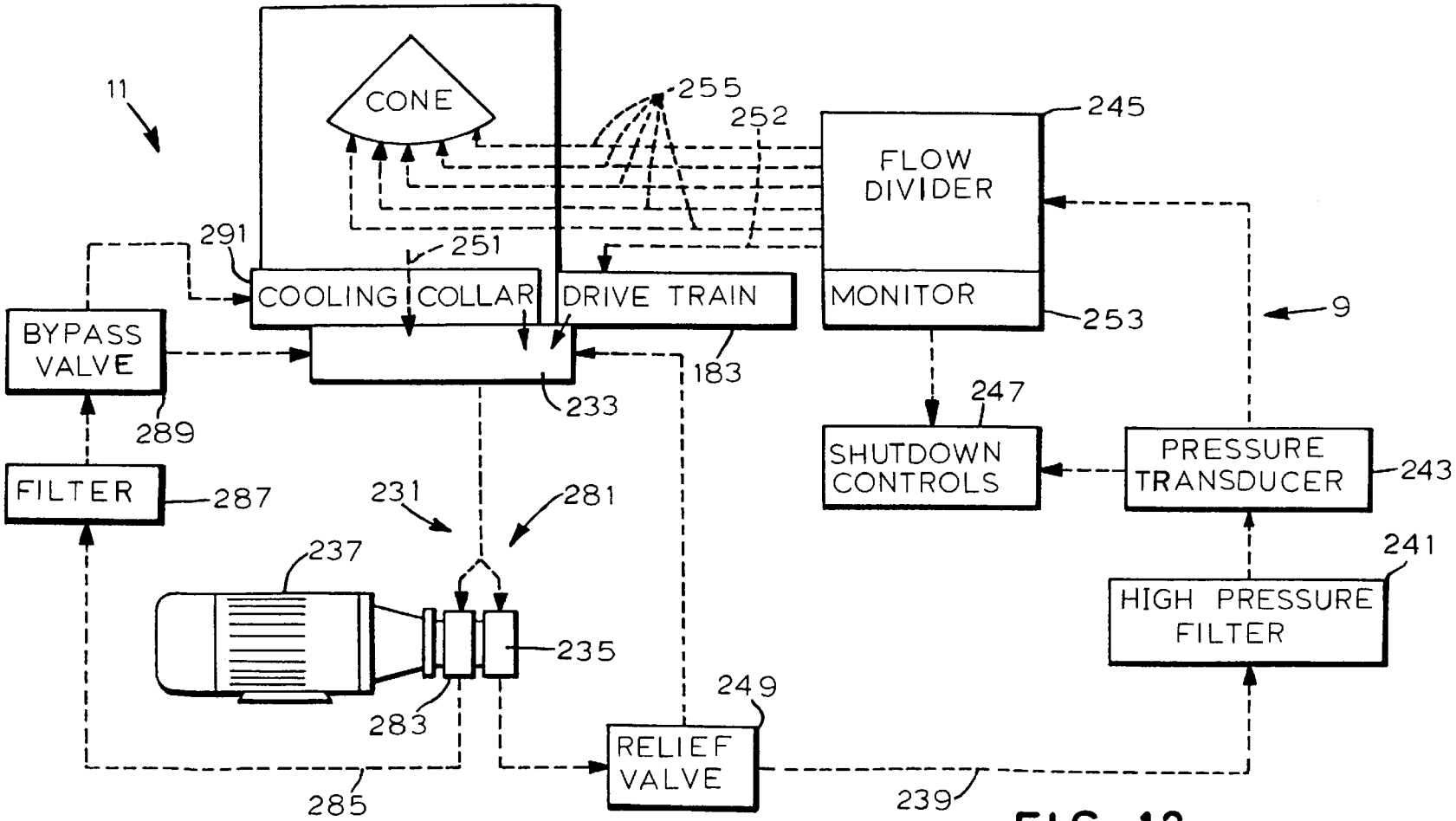
FIG. 13 is a schematic representation of a lubricating system of the gyratory crusher having an automatic control system.

Oil for the first pumping arrangement 231 is contained in an oil pan 233. The first pumping arrangement 231, as schematically illustrated in FIG. 13, draws oil from the oil pan 233 by a lubricating portion 235 of a pump 237 and directs that oil by an oil line 239 through a high-pressure filter 241, a pressure transducer 243 and a flow divider 245. If a failure should occur whereby oil pressure should unexpectedly drop at the pressure transducer 243, such as a broken oil line, the pressure transducer 243 is adapted to signal shut-down controls 247, which immediately shut-down operation of the crusher 1. If, instead, oil pressure in the oil line 239 should exceed a certain pre-determined level, oil will be bled from the oil line 239 by a relief valve 249 and routed back to the oil pan 233.

The flow divider 245 distributes oil flowing therethrough separately to each of the hydrostatic thrust bearings 161 and to the drive pinion arrangement 183, from where the oil gravitationally returns to the oil pan 233, as indicated by the arrow designated by the numeral 251 in FIG. 13. The flow divider 245 also distributes oil to the drive train 183, as indicated by the dashed line designated by the numeral 252.

Monitoring means 253 monitors the volume of oil being 3 processed through the flow divider 245. If oil flow to the hydrostatic thrust bearings 161 or the drive pinion arrangement 183, as evidenced by a reduction in volume of oil flow therethrough as determined by the monitoring means 253, the monitoring means 253 will signal the shut-down controls 247 to immediately shut-down operation of the crusher 1.

Pressurized oil is conveyed from the flow divider 245 to the interface between the hydrostatic bearings 161 and the bottom surface 165 of the cone head 61 by oil channels 255 for lubrication purposes. The oil is sufficiently pressurized whereby the cone head 61 is slightly elevated and supported on a thin film of oil on each of the hydrostatic bearings 161. Oil sprays outwardly from the interface between the hydrostatic bearings 161 and the bottom surface 165 of the cone head 61 and, as it cascades downwardly, lubricates the other moving parts of the head mounting means 5 there below. Spring loaded wiper rings 257 cause oil sprayed radially outwardly from the hydrostatic bearings 161 to be directly downwardly onto a seal bearing 259. Weep holes 261 drain oil from the seal bearing 259 and other pockets for gravitational return to the oil pan 233.

The thermal stress relief means 11 is also self-contained and includes a second pumping arrangement 281. The second pumping arrangement 281 draws oil from the oil pan 233 by a cooling portion 283 of the pump 237 and directs that oil through oil line 285 and a filter 287. If the oil temperature should be lower than a pre-determined temperature, a bypass valve 289 diverts the oil from the oil line 285 to the oil pan 233. When the oil in oil line 285 reaches or exceeds that pre-determined temperature, oil is no longer diverted by the bypass valve 289 but, instead, is directed through half-collars 291 abutting a wall 293 of the lower frame portion 21 and into the oil pan 233. The half collars 291, as shown in FIG. 6, and the oil circulated therethrough are adapted to elevate the temperature of the wall 293 to a temperature more closely approximately the temperatures in the head mounting means 5 to reduce thermal stresses within the lower frame portion 21 of the crusher 1.

Actually, the thermal relief means 11 serves a dual purpose. In addition to relieving the thermal stress, the thermal relief means 11 also serves as a cooling means for the lubricating oil. In addition to the thermal energy conducting inwardly through the wall 293 to relieve the thermal stress caused by crushed material impacting with and cooling the wall 293, thermal energy also radiates and convects outwardly from the half collars 291 to the ambient atmosphere to cool the lubricating oil.

The dust seal means 13 is adapted to isolate inner moving components, such as the interface between the hydrostatic bearings 161 and the bearings 135, 137 and 141, from abrasive contamination arising from the ubiquitous dust and grit generated during the crushing process. The dust seal means 13 includes a flexible seal 301 having an outer edge 303 secured to a lower extremity 305 of the cone head 61 and an inner edge 307 secured to an outer race 309 of the seal 259, an inner race 311 of which is secured to the thrust seats 163. Bearing balls 312 are captured between the inner race 311 and the outer race 309 in peripheral grooves thereof.

Figure 10:
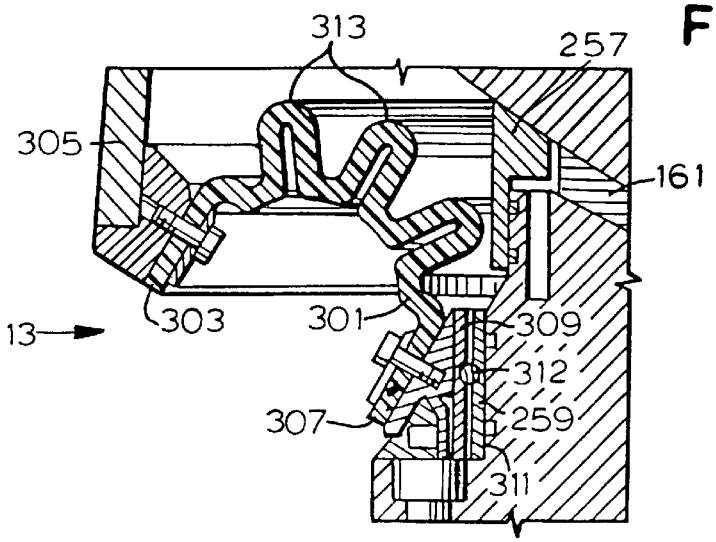
FIG. 10 is a yet further enlarged and fragmentary, partially cross-sectional view of the gyratory crusher, showing a dust seal arrangement thereof in the vicinity of a closed side setting of the gyratory crusher having an automatic control system.

To provide the flexibility needed to compensate for the oscillatory displacement of the cone head 61 due to the gyratory motion thereof, the flexible seal 301 generally has a single-wall construction with a corrugation-like cross-sectional configuration, as shown in FIG. 10. As the separation between the mantel 63 and the bowl liner 35 at a particular point along the gap 213 approaches the closed side setting, the corrugations or fingers 313 widen to compensate for the corresponding increasing separation between the lower extremity 305 and the seal bearing 301. Similarly, as the separation between the mantel 63 and the bowl liner 35 approaches the open side setting, the fingers 313 become narrower to compensate for the corresponding decreasing separation between the lower extremity 305 and the seal bearing 301.

To compensate for rotation of the cone head 61 relative to the bowl liner 35 during a crushing operation, the outer race 309 rotates with the cone head 61, peripherally relative to the inner race 311.

Alternatively, the dust seal means 13 may include a flexible seal 321 having a double-wall construction that forms a bladder 323 therebetween, as shown in FIG. 12. For some applications, it may be desirable to pressurize the bladder 323, such as between one to five pounds per square inch.

The tramp iron relief system 15 includes a lower radial member 331 secured to and spaced radially outwardly from an upper end 333 of the wall 293 of the lower frame portion 21. A peripheral groove 335 is formed in an outer edge 337 of the lower radial member 331. A plurality of equidistantly spaced partial bores 341 extend radially inwardly from the groove 335, as shown in FIG. 2. For example, the tramp iron relief system 15 may include eight of the partial bores 341.

In addition, a port 343 is provided from each of the partial bores 341 through a lower surface 345 of the lower radial member 331, as shown in FIG. 3. The ports 343 are spaced outwardly from the wall 293 whereby a cylinder 347, can be connected to and suspended downwardly from a respective one of each of the ports 343. If desired, the cylinders 347 may be connected to the ports 343 by inserts 349, as shown in FIG. 3, preferably constructed of a dissimilar metal, such as brass or other suitable material to minimize or eliminate galling when removing the cylinders 347 from the ports 343. The cylinders 347 are spaced in close proximity to the wall 293.

The tramp iron relief system 15 also includes a skirt 351 secured to the lower radial member 331 as shown in FIG. 4. The skirt 351 extends downwardly from the lower radial member 331 to provide some protection for the cylinders 347. If desired, a groove 353 may be provided along an inner peripheral surface of the skirt 351 to complement and provide greater flow capacity for hydraulic fluid being conveyed along the groove 335.

A piston rod 355 extends downwardly from each of the cylinders 347 and connects to a respective one of a plurality of rocker arm arrangements 357. Each of the rocker arm arrangements 357 has an extension 359 extending through a respective one of a plurality of guides 361. A pair of opposing pull rods 371 extend upwardly from each end of a respective one of the rocker arm arrangements 357, through corresponding openings 373 in the lower radial member 331, and through additional corresponding openings 375 in an upper radial member 377, secured to and spaced radially outwardly from the wall 197 of the upper frame portion 23. Split keepers 379 connected to upper ends of each of the pull rods 371 provide means for hydraulically providing substantial hold-down forces between the upper frame portion 23 and the lower frame portion 21.

The tramp iron relief system 15 also includes a plurality of accumulators 385. For example, the crusher 1 may have one of the accumulators 385 positioned in every other space between the cylinders 347. Each of the accumulators 385 are connected in flow communication with the groove 335, similarly to that provided by the ports 343 and the partial bores 341 for the cylinders 347 and, preferably, by inserts similar to the inserts 349. An appropriately spaced input port 387 is provided for injecting hydraulic fluid into the tramp iron relief system 15 from an external hydraulic source 388, as schematically shown in FIG. 1.

Each of the accumulators 385 are affixed to the wall 293 by accumulator attaching means, comprising a pair of opposing locators 389 and an interconnecting hanger 391. Each of the locators 389 is spaced outwardly from the wall 293 by standoffs 392. The locators have a pair of slots in a base 393 thereof that allows a cylindrical edge 394 thereof to be placed and affixed in abutting engagement with the respective accumulator 385, as shown in FIGS. 5 and 15. The hanger 391 has a threaded connector 395 at each end thereof to clamp the accumulator 385 against the cylindrical edges 394.

One of the distinct advantages provided by the present invention is the elimination of all external plumbing of a hydraulic system for tramp iron relief purposes.

In an application in accordance with the present invention, hydraulic fluid is injected into the system to pressurize the hydraulics of the tramp iron relief system 15 to a selected pressure; for example, 2,000–2,400 psi or other suitable pressure as appropriate to clamp the upper frame portion 23 to the lower frame portion 21, particularly across the V-seat arrangement 25.

The closed side setting is adjusted by displacing the bowl liner 35 upwardly or downwardly as needed by clockwise or counterclockwise rotation of the elevating ring gear 191 as appropriate. The first pumping arrangement 231 is activated to provide lubricating oil to the hydrostatic thrust bearings 161 and the drive pinion arrangement 183. The second pumping arrangement 281 is activated to provide oil to the half collars 291 after the oil reaches or surpasses a pre-determined temperature. Drive means, such as a prime mover 397 as schematically indicated in FIG. 2, is drivingly engaged with the sheave 185 to initiate gyration of the cone head 61 relative to the bowl liner 35.

Rock, ores or other material are dropped through the upper opening 53 of the bowl liner 35 and are crushed between the mantel 63 and the bowl liner 35 as the material being crushed is gravitationally urged through the crushing chamber 211 to be discharged through the gap 213 thereof. As the crushing operation progresses, the temperature of the oil increases until the pre-determined temperature setting of the bypass valve 289 is reached or exceeded. Then, the bypass valve 289 directs the oil passing through the second pumping arrangement 281 to and through the half collars 291.

The trajectory of crushed material being discharged from the gap 213, which is generally much cooler than the oil, bearings and other moving parts of the crusher 1, causes the crushed material to impact with the wall 293, thereby cooling the wall 293. Due to the temperature difference between the cooled wall 293 and that of the moving components of the crusher 1, prior art crushers endure thermal stresses in addition to the substantial physical stresses inherent in the crushing process. In the present invention, however, the oil circulated through the half collars 291 warms the wall 293, thereby counteracting the cooling effect of the crushed material impacting with the wall 293. As a result, thermal stresses in the crusher 1 of the present invention are substantially reduced from those of prior art crushers.

As non-crushable material that is too large to be processed through the crushing chamber 211, sometimes referred to as "tramp iron", is dropped into the crushing chamber 211, a portion of the bowl liner 35 and the association portion of the upper frame portion 23 are forced upwardly from the cone head 61, causing the corresponding portion of the V-seat arrangement 25 to separate. As the upper frame portion 23 is forced upwardly, corresponding ones of the pull rods 371, which are secured to the upper radial member 377 by the split keepers 379, and the rods 355 connected to the pull rods 371 by the rocker arm arrangements 357 are also forced upwardly.

As the rods 355 are forced upwardly, pistons 399 push hydraulic fluid thereabove into the enclosed peripheral groove 335. The hydraulic fluid flows along the groove 335 to each of the plurality of accumulators 385 connected in flow communication with the groove 335. As the added pressure in the hydraulic fluid is conveyed to the accumulators 385, compressed bladders 401 within the accumulators 385 are further compressed to temporarily store the added mechanical energy caused by the tramp iron passing through the crushing chamber 211.

Immediately after the tramp iron has worked its way through the crushing chamber 211 and dropped from the gap 213, thereby relieving the upwardly thrusting forces previously exerted by the tramp iron, the extra pressure stored in the bladders 401 is dissipated as the upper frame portion 23, which was forced upwardly, returns to its rest position about the V-seat arrangement 25, also returning the pistons 399, the piston rods 355, the rocker arm arrangements 357, and the pull rods 371 to their rest positions. As the V-seat arrangement 25 is disturbed, such as during passage of tramp iron or "bowl float", stop pins 403 prevent rotation of the upper frame portion 23 relative to the lower frame portion 21. Sleeves or inserts 405 are readily removable to facilitate replacement of worn parts interacting with the stop pins 403 and of the pins 403 themselves to thereby minimize maintenance costs.

"Bowl float" is well known in the art to indicate the condition wherein the upper frame portion 23 is repeatedly lifted from and bounced or vibrated against the lower frame portion 21. Bowl float generally occurs when a non-crushable object is fed into the crusher 1 or when the crusher 1 is operated with a closed side setting that is too small. In the crusher of the present invention, bowl float can rapidly cause substantial damage to the crusher 1, particularly in regard to the V-seat arrangement 25 and the stop pins 403.

The tramp iron relief system 15 hereinbefore described is designed to process such non-crushable objects through the crusher 1 and return the crusher 1 to normal operation. In order for the crusher 1 to be essentially fully automated, a control system 421 thereof must be able to detect bowl float and respond accordingly. The control system 421 includes a plurality of separation sensors 423 that are adapted to detect separation of the upper frame portion 23 from the lower frame portion 21. For applications employing two of the separation sensors 423, the sensors 423 are generally mounted 180° apart on the lower frame portion 21 whereby the separation sensors 423 can sense a metallic target of the upper frame portion 23, such as a bottom surface of the upper radial member 377.

The separation sensors 423 are adapted to sense a range of separations of the upper frame portion 23 from the lower frame portion 21, such as from 4 to 11 mm., s and to communicate an analog voltage to a control unit 425 wherein that voltage is proportional to the amount of separation. The control unit 425 is configured to operatively detect a pre-defined bowl float condition, such as greater than one hundred twenty pulses within one minute wherein the magnitude of those pulses correspond to a separation between the upper frame portion 23 and the lower frame portion 21 of greater than 1.5 mm. It is to be understood that signals from any one of the separation sensors 423 is sufficient to define bowl float as one of the separation sensors 423 may be situated wherein there is little or no separation between the upper frame portion 23 and the lower frame portion 21 and, in fact, produce signals that would indicate "negative" separation.

Alternatively, variations in the pressure of the hydraulic fluid of the tramp iron relief system 15 may be used as an indicator of bowl float.

Figure 17:
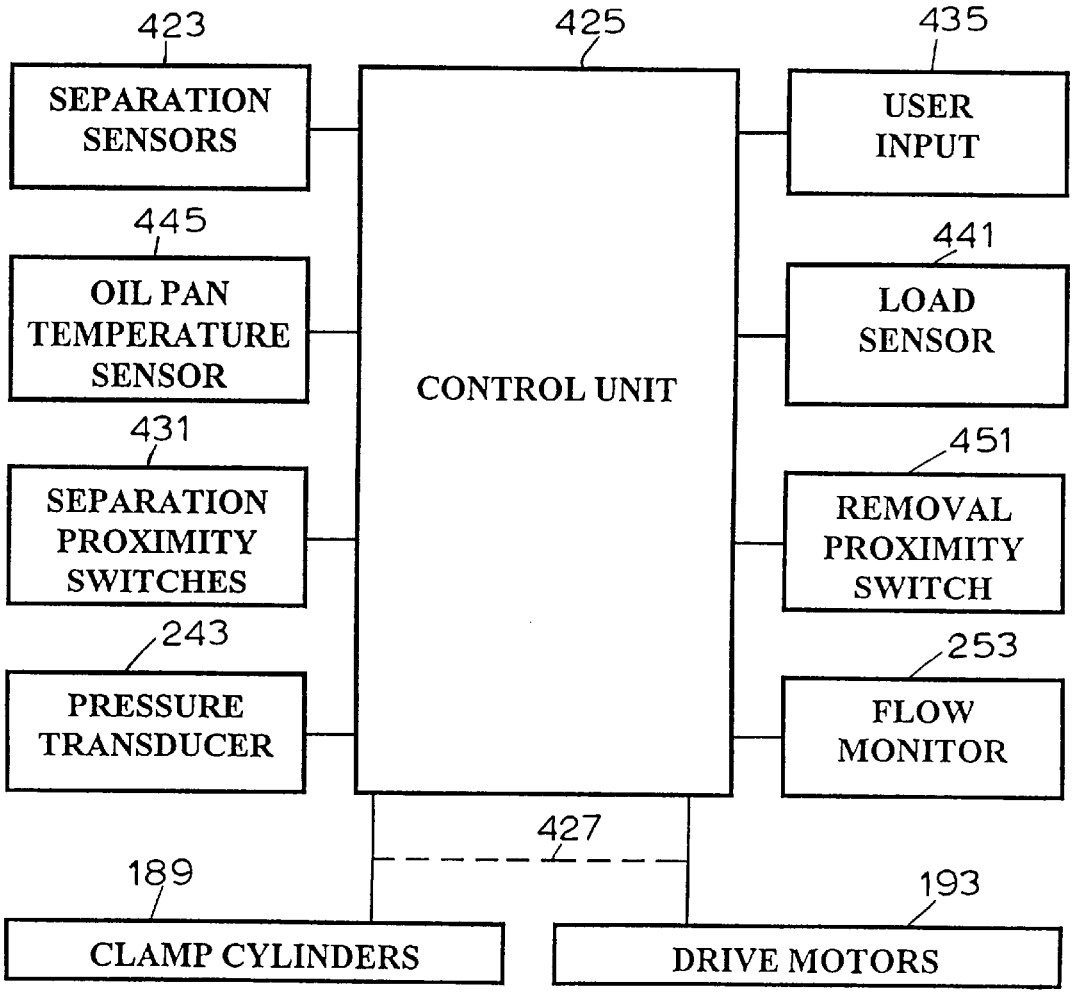
FIG. 17 is a schematic diagram of a control system of the gyratory crusher.

If the control unit 425 determines that the defined bowl float condition does exist, the control unit 425 may take various courses of action, including signaling shut down of the crusher 1 as hereinbefore described in regard to the shut down controls 247, or causing the clamp cylinders 189 to release some of their clamping pressure and causing the drive motors 193 to rotate the bonnet 31 whereby the separation between the bowl liner 35 and the mantel 63 are increased. Due to the manner is which the bonnet 31 is elevatable relative to the upper frame portion 23, the bowl float condition can be automatically removed as the crusher 1 continues the crushing operation. The clamping pressure is reduced only enough, such as by fifty percent, to allow the drive motors 193 to rotate the bonnet 31 and is not entirely removed to prevent encouragement of bowl float of greater and possibly more destructive magnitude. The association between the clamp cylinders 189 and the drive motors 193 is indicated by the dashed line designated by the numeral 427 in FIG. 17.

The amount of rotation of the bonnet 31 needed to eliminate the bowl float condition can be determined and controlled by the control unit 425. For example, the control unit 425 can monitor signals from the separation sensors 423 to determine in real time when the definition of bowl float is no longer present and accordingly discontinue operation of the drive motors 193. Or, the control unit 425 can cause the drive motors 193 to rotate the bonnet 31 for a short, selected period of time and re-examine whether the definition of bowl float is still satisfied. If so, similar rotations can be repeated until bowl float ceases. Further, the control unit 425 can cause the drive motors 193 to rotate the bonnet 31 through a selected angular rotation in order to produce a corresponding increase in the spacing between the bowl liner 35 and mantel 63 which was known to eliminate similar bowl float conditions.

The control system 421 includes monitoring means configured to operatively monitor changes in spacing between the bowl liner 35 and the mantel 63, such as a pair of proximity switches 431 for monitoring rotation of the bonnet 31 through a selected angular rotation whereby the spacing between the bowl liner 35 and the mantel 63 is increased or decreased by a known amount. The proximity switches 431 are mounted on one of the drive motors 193 whereby each of the proximity switches 431 detects and counts the number of teeth of a toothed arrangement, such as a gear 433 of the drive motor 193 passing thereby, as shown in FIG. 18. For an application wherein the ring gear 191 has one hundred sixty teeth and the threads 33 have a pitch of two inches, eight teeth which represents one twentieth of one revolution of the ring gear 191 would represent an change in elevation of the bonnet 31 of 1/20 times two inches, or 0.1 inch. The proximity switches 431 are spaced whereby quadrature signals therefrom are out of phase with each other, similar to that of a two channel optical encoder, thereby permitting devices monitoring those signals to determine whether the gear 433 is turning clockwise or counterclockwise.

The control system 421 also provides means for setting the closed side setting of the crusher 1. The closed side setting occurs at the lower end of the crushing chamber 211 whereat the surface of the bowl liner 35 is parallel to the corresponding surface of the mantel 63, sometimes referred to as the parallel zone. The control system 421 includes calibrating or zeroing means for determining a closed side setting of essentially zero, such as by operating the crusher 1 empty without any material being crushed therein, by operating the drive motors 193 to rotate the ring gear 191 such that the bowl liner 35 is displaced downwardly toward the mantel 63, and by observing the point at which the crusher 1 assumes bowl float condition as the closed side setting nears a separation of zero, sometimes referred to as "crusher zero".

Then, the drive motors 193 are reversed and rotated by the desired "number of teeth" needed to provide the corresponding separation between the bowl liner 35 and the mantel 63 across the parallel zone. As the parallel zone is not horizontal but, instead, is oriented at an acute angle, it should be understood that such angular relationship must be taken into consideration when determining the magnitude of vertical displacement of the bowl liner 35 that is needed in order to obtain the desired closed side setting. The desired closed side setting can be keyed into the control unit 425 by a user, with the control unit 425 in conjunction with the proximity switches 431 and the drive motors 193 automatically establishing the closed side setting. It is to be understood that a user can input a new closed side setting, as indicated by the numeral 435 in FIG. 17, such as for producing crushed material for a different project that requires different size specifications and the control unit 425 adjusting the closed side setting accordingly.

The gradation of crushed material exiting from the crusher 1 is dependent on the accuracy of the settings, and particularly the closed side setting. Thus, if the rate of wear of the bowl liner 35 and the mantel 63 for each hour that the crusher 1 is known, the control unit 425 can periodically and automatically operate the drive motors 193 to accordingly re-establish and maintain the desired closed side setting. A rate of wear can be input into the control unit 425 by the user. Periodically, such as each morning at startup, "crusher zero" can be re-determined. The displacement required to return to crusher zero, actual closed side setting, can be automatically compared with the "calculated" closed side setting operationally established during the previous crushing period and, after adjusting for the number of hours that the crusher 1 was operated during that previous crushing period, automatically determine, or "learn", a new rate of wear that is automatically stored by the control unit 425. A more recent "learned" rate of wear can be automatically determined as frequently as desired.

It is known in the art that as the closed side setting decreases for a crusher powered by an electrically driven prime mover 397, a load sensor 441 such as a signal indicating the amperage drawn by the prime mover 397, increases; conversely, as the closed side setting increases, such as by wearing of crushing surfaces during the crushing operation, the amperage drawn by the prime mover 397, as indicated by the load sensor 441, decreases. Thus, in addition to adjusting the closed side setting based on rate of wear per operating hour of the crusher, the control system 421 may also monitor the amperage drawn by the prime mover 397. The amperage is determined by the load sensor 441 and communicated to the control unit 425, where it is filtered and smoothed. If the amperage has increased or decreased by a designated amount from the amperage known to correspond to the desired closed side setting, the control unit 425 automatically activates the drive motors 193 to narrow the closed side setting to increase the amperage drawn by the prime mover 397 or to widen the closed side setting to decrease that amperage, as appropriate.

As the closed side setting decreases, the power utilized by the crusher 1 will increase and the temperature of the lubricating oil in the oil pan 233 will increase accordingly; conversely, as the closed side setting increases, such as by wearing during the crushing operation, the temperature of the lubricating oil in the oil pan 233 will decrease. Thus, for a crusher 1 utilizing a non-electrically driven primer mover 397, such as a diesel engine or the like, signals from the load sensor 441, such as a governor in the case of a non-electrically driven prime mover 397 or an oil pan temperature sensor 445 for example, may be used in conjunction with a non-electrically driven prime mover 397 similarly to the load sensor 441 as used with an electrically driven prime mover 397. It should be understood that it may be desirable to also use the oil pan temperature sensor 445 in conjunction with the load sensor 441 when utilizing an electrically driven prime mover 397.

The control unit 425 may also be used to sufficiently elevate the bonnet 31 whereby the threads 33 are no longer enmeshed and the bonnet 31 and bowl liner 35 and be hoisted from the upper frame portion 23. A user input 435, such as a "clearing" or other appropriate command, may be entered instructing the control unit 425 to partially or totally release the clamp cylinders 189 and to activate the drive motors 193 until the threads 33 of the bonnet 31 disengage from the threads 33 of the upper frame portion 23.

Indicator means, such as a removal proximity switch 451, signals the control unit 425 when the threads 33 are either disengaged or will be disengaged after a predetermined additional angular rotation of the bonnet 31, such as an additional one-half revolution for example. An orifice or notch 461 in the wall 197, as shown in FIG. 19, activates the removal proximity switch 451 as the threads 33 are clear or almost clear as aforesaid. The control unit 425 then deactivates the drive motors 193 or deactivates them after the pre-determined additional angular rotation of the bonnet 31.

The control system 421 may also include tracking means for tracking the quantity of bowl float conditions that occur within a selected time interval. In the event that the quantity of bowl float conditions occurring within the selected time interval exceeds a pre-determined quantity, which may indicate that the user is operating the crusher 1 in a manner that may considerably shorten the useful life of the crusher 1, the control unit 425 may also include shutdown means for shutting down the crusher 1 whereafter the crusher 1 can only be reactivated by the owner of the crusher 1. In addition, the control system 421 may track the total lifetime quantity of bowl float conditions occurring to the crusher 1 to thereby provide some indication of the remaining useful life of the crusher 1.

Although the foregoing discussions have described the control system 421 as being an integral part of the crusher 1, it is to be understood that adaptation of the control system 421 to numerous other crusher designs, both present existing and future designs, lies within the nature and spirit of the present invention.

It is to be understood that the control unit 425 may include the shutdown controls 247 as hereinbefore described, with signals from the flow monitor 253 and the pressure transducer 243 being communicated to the control unit 425.

It is to be understood that while certain forms of the present invention have been illustrated and described herein, it is not to be limited to the specific forms or arrangement of parts described and shown.

What is claimed and desired to be secured by Letters Patent is as follows:

1. A gyratory crusher for crushing material, comprising:

(a) a lower frame portion;

(b) an upper frame portion supported by said lower frame portion;

(c) a bonnet threadably supported by said upper frame portion, said bonnet having a replaceable bowl liner with an upper opening for receiving the material;

(d) an eccentric member;

(e) a crusher head having a replaceable mantel;

(f) a mounting mechanism structured to pivotally mount said eccentric member on said lower frame portion about a first axis spaced centrally and vertically relative to said lower frame member, and to pivotally mount said crusher head on said eccentric member about a second axis spaced generally centrally and vertically relative to said lower frame portion wherein said second axis is angularly offset from said first axis and intersects said first axis above said crusher head and wherein a crushing chamber is formed between said bowl liner and said mantel; said crushing chamber having a gap comprising a closed side setting at a lower extremity thereof;

(g) electric motor apparatus structured to rotate said eccentric member about said first axis; and (h) a control mechanism structured to:

(1) automatically control the width of said gap during operation of said gyratory crusher by monitoring the magnitude of current drawn by said electric motor apparatus and by threadably advancing said bonnet relative to said upper frame portion; and (2) to operatively detect a pre-defined bowl float condition of said crusher.

2. The crusher according to claim 1, wherein said control mechanism includes at least one separation sensor configured to operatively detect separation of said upper frame portion from said lower frame portion.

3. The crusher according to claim 2, wherein said at least one separation sensor is structured to generate a signal that is proportional to the magnitude of separation of said upper frame portion from said lower frame portion adjacent to said at least one separation sensor.

4. The crusher according to claim 1, wherein said control mechanism is configured to responsively increase said width of said gap upon detection of said bowl float condition of said crusher.

5. The crusher according to claim 1, wherein said control mechanism includes a monitoring mechanism configured to operatively control magnitude and direction of changes in width of said gap by monitoring rotation of said bonnet relative to said upper frame portion.

6. The crusher according to claim 5, wherein said control means includes a ring gear mounted to said bonnet and a drive motor mounted to said frame having a pinion engaging said ring gear, said monitoring mechanism including a pair of proximity switches configured to operatively interact with said said pinion.

7. The crusher according to claim 6, wherein said control mechanism includes a calibrating mechanism structured to determine the spacing of said bonnet relative to said upper frame portion as said gap has a minimal width.

8. The crusher according to claim 1, wherein said control mechanism is configured to operatively compensate for a wearing rate of said bowl liner and said mantel by responsively displacing said bowl liner relative to said mantel.

9. The crusher according to claim 1, wherein said control mechanism is configured to operatively determine an updated wearing rate of said bowl liner and said mantel.

10. The crusher according to claim 1, wherein said crusher includes a drive mechanism, and said control mechanism includes a load sensor responsive to said drive mechanism and wherein said control mechanism is configured to operatively adjust said width of said gap in response to changes in signals from said load sensor.

11. The crusher according to claim 1, wherein said control mechanism is configured to operatively and threadably adjust said bonnet such that said bonnet is vertically hoistable from said upper frame portion.

12. The crusher according to claim 11, wherein said control mechanism includes an indicator mechanism structured to operably indicate whereat said bonnet is vertically hoistable from said upper frame portion.

13. The crusher according to claim 1, wherein said control mechanism includes a tracking mechanism structured to track a quantity of bowl float conditions that occur within a selected time interval.

14. The crusher according to claim 1, wherein said control mechanism includes a shutdown mechanism structured to shut down said crusher in the event that a quantity of bowl float conditions occurring within a selected time interval exceeds a pre-determined quantity thereof.

15. A control system for a gyratory crusher, wherein said crusher includes an upper frame portion having a bowl liner and a crushing head having a mantel such that a crushing chamber having a gap is formed between the bowl liner and the mantel, said control system comprising:

a) a detecting mechanism structured to detect a predefined bowl float condition of the crusher; and b) an adjusting mechanism structured to automatically adjust a width of the gap to thereby eliminate said bowl float condition.

16. The control system according to claim 15, wherein said adjusting mechanism includes a monitoring mechanism structured to determine magnitude and direction of changes in the width of the gap by monitoring rotation of the bowl liner relative to the upper frame portion.

17. The control system according to claim 15, wherein said adjusting mechanism is structured to automatically adjust the width of the gap to operatively compensate for a wearing rate of the bowl liner and the mantel.

18. The control system according to claim 15, including a shutdown mechanism structured to responsively shut down the crusher in the event that a quantity of bowl float conditions occurring within a selected time interval exceeds a pre-determined quantity thereof.

19. A gyratory crusher for crushing material, comprising:

(a) a lower frame portion;

(b) an upper frame portion supported by said lower frame portion;

(c) a bonnet adjustably supported by said upper frame portion, said bonnet having an upper crushing surface and an upper opening for receiving the material;

(d) an actuator connected to said bonnet for adjusting the position of said bonnet relative to said upper frame portion;

(e) a crusher head supported by said frame, said crusher head being operatively connected to a motor, said crusher head being spaced relative to said bonnet such that a gap is formed therebetween; and (f) a controller operatively connected to said actuator for controlling the width of the gap during operation of said crusher, said controller including a separation sensor for detecting a bowl float condition, said controller adjusting the position of said bonnet relative to said upper frame to thereby eliminate the bowl float condition.

20. The crusher of claim 19, wherein said separation sensor includes a position sensor for measuring the gap.

21. The crusher of claim 19, wherein said separation sensor includes a current sensor for monitoring the magnitude of current drawn by the motor, said separation sensor generating a signal proportional to the width of the gap.

22. The crusher of claim 19, wherein said bonnet is threadably mounted to said upper frame.

23. The crusher of claim 22, wherein said actuator includes a ring gear mounted to said bonnet and a drive motor mounted to said frame having a pinion engaging said ring gear, said drive motor and said pinion cooperating to rotate said bonnet.

24. The crusher of claim 23, including a position monitor for monitoring changes in position of said bonnet relative to said frame due to said actuator, said position monitor having a pair of proximity switches operatively interacting with said pinion.

25. The crusher of claim 19, wherein said crusher head is supported on said frame by hydrostatic thrust bearings, and further including a lubrication system for supplying lubricant to said thrust bearings, said lubrication system including a pressure sensor operatively connected to said controller for terminating operation of said crusher in response to a malfunction of said lubrication system.

26. The crusher of claim 19, wherein said controller compensates for a wearing rate of said bowl liner and said crusher head by adjusting the position of said bonnet relative to said crusher head.

27. The crusher of claim 19, wherein said controller includes a load sensor operatively connected to the motor, said load sensor for generating a signal indicative of the load on the motor, and wherein said controller adjusts the width of the gap in response to said signal.

* * * * *

UNITED STATES PATENT AND TRADEMARK OFFICE

CERTIFICATE OF CORRECTION

PATENT NO. : 5,927,623
DATED : July 27, 1999
INVENTOR(S) : Ferguson et al.

It is certified that error appears in the above-identified patent and that said Letters Patent is hereby corrected as shown below:

Column 8,
Line 50, delete “the”.

Column 9,
Line 67, delete “3”.

Column 13,
Line 63, delete “s” between “mm.,” and “and”.

Column 14,
Line 22, delete first “is”, insert -- in --.
Line 63, delete “an”, insert -- a --.

Column 17,
Line 63, delete first “said”.

Signed and Sealed this

Fourth Day of January, 2005

JON W. DUDAS
*Director of the United States Patent and Trademark Office*